US008011372B2

(12) United States Patent
Neumann et al.

(10) Patent No.: US 8,011,372 B2
(45) Date of Patent: Sep. 6, 2011

(54) DEVICE FOR FILLING CIGARETTE TUBES WITH TOBACCO

(75) Inventors: Manfred Neumann, Radevormwald (DE); Volker Schmidt, Radevormwald (DE)

(73) Assignee: Philip Morris USA Inc., Richmond, VA (US)

( * ) Notice: Subject to any disclaimer, the term of this patent is extended or adjusted under 35 U.S.C. 154(b) by 599 days.

(21) Appl. No.: 12/081,552

(22) Filed: Apr. 17, 2008

(65) Prior Publication Data

US 2008/0257364 A1 Oct. 23, 2008

(30) Foreign Application Priority Data

Apr. 20, 2007 (EP) ..... 07106556

(51) Int. Cl.
*A24C 5/001* (2006.01)

(52) U.S. Cl. ..... 131/70; 131/75

(58) Field of Classification Search ..... 131/70–75
See application file for complete search history.

(56) References Cited

U.S. PATENT DOCUMENTS

2006/0096604 A1* 5/2006 Moser et al. ..... 131/70

FOREIGN PATENT DOCUMENTS

| | | | |
|---|---|---|---|
| DE | 8802619 | U1 | 4/1988 |
| DE | 20315767 | U1 | 1/2004 |
| DE | 202005012273 | U1 | 10/2005 |
| DE | 202006001708 | U1 | 10/2006 |
| EP | 0584805 | A1 | 3/1994 |
| EP | 1604576 | A | 12/2005 |
| WO | WO 2006/102763 | A | 10/2006 |

OTHER PUBLICATIONS

Written Opinion received Oct. 15, 2008 for PCT/EP2008/054704.
European Search Report dated Oct. 10, 2007 for European Application No. 07106556.

* cited by examiner

*Primary Examiner* — Richard Crispino
*Assistant Examiner* — Dionne W Mayes
(74) *Attorney, Agent, or Firm* — Buchanan Ingersoll & Rooney PC

(57) ABSTRACT

A device for filling cigarette tubes with tobacco, wherein the device comprises at least one separating means adapted to detach a tobacco portion from a tobacco block and at least one portioning means adapted to portion the tobacco block, at least one transport means adapted to transport the tobacco block towards the separating means, wherein the portioning means and the transport means are coupled such that the transport means transports the tobacco block in a number of transport steps, and at least one filling means adapted to fill a cigarette tube with the detached tobacco portion. The device further comprises at least one blocking means adapted to block the transport means after each transport step until the at least one filling means has been operated.

13 Claims, 5 Drawing Sheets

DEVICE FOR FILLING CIGARETTE TUBES WITH TOBACCO

CROSS-REFERENCE TO RELATED APPLICATION

This application claims priority under 35 U.S.C. §119 to European Application No. 07106556.9, filed Apr. 20, 2007, the entire content of which is hereby incorporated by reference.

FIELD OF THE INVENTION

The present invention relates to a device for filling cigarette tubes with tobacco. The device comprises at least one separating means adapted to detach a tobacco portion from a tobacco block and at least one filling means adapted to fill a cigarette tube with the detached tobacco portion.

BACKGROUND

International Patent Application WO2007/082939 describes a device for filling cigarette tubes with a tobacco portion. This device comprises portioning means adapted to portion a tobacco block, transport means adapted to transport the forward end of the tobacco block into a shaping chamber, separating means adapted to detach a tobacco portion from the forward end of the tobacco block transported into the shaping chamber and filling means adapted to fill a cigarette tube with the detached tobacco portion. The portioning means and the transport means are coupled such that the transport means transports the tobacco block in a number of transport steps and each transport step corresponds to one tobacco portion. Depending on the number of times the user of the device actuates the portioning means, the number of tobacco portions transported into the shaping chamber varies.

It is the object of the invention to further improve such a device with regard to filling the cigarette tubes with a substantially identical quantity of tobacco, starting from pre-portioned or non-pre-portioned tobacco material.

SUMMARY

According to the invention this object is achieved by a device comprising at least one separating means adapted to portion a tobacco block, at least one transport means adapted to transport the tobacco block towards the separating means, at least one filling means adapted to fill a cigarette tube with the detached tobacco portion and wherein the portioning means and the transport means are coupled such that the transport means transports the tobacco block in a number of transport steps. According to the device of the invention, the device further comprises at least one blocking means adapted to block the transport means after each transport step until the at least one filling means has been operated, that is until the detached tobacco portion has been filled into the cigarette tube.

In the context of the present invention, the term "tobacco portion" denotes the quantity of tobacco that is used to fill one cigarette tube. The term "tobacco block" denotes a unit of compressed cut filler or shredded tobacco or both, the quantity of tobacco of which exceeds that contained in a tobacco portion and advantageously represents a multiple thereof. The tobacco block may be pre-portioned or non-pre-portioned, a non-pre-portioned tobacco block being preferred. If a pre-portioned tobacco block is used, its portioning unit may or may not correspond to the tobacco portion which is specified by the portioning means according to the device of the invention. A portioning means according to the invention is a means which allows the operator of the device of the invention to detach from a tobacco block the quantity of tobacco which corresponds to one tobacco portion.

The separating means may be, for example one or more blades, rasps, screws, worms or wheels, that may act upon the tobacco block in order to separate the tobacco portion all at once, in part-quantities or continuously. For example, the separation takes place for example with a blade. Advantageously the cohesion inside the separated tobacco portion is not loosened. The separated tobacco portion is preferably substantially in one piece, wherein this piece already substantially has the shape of a tobacco rod. The separation of a tobacco portion in part-quantities is carried out with several cuts of the same blade or different blades. The continuous separation may be carried out for example with a rasp or other rotary element. The separated tobacco portion is put or delivered in a shaping chamber.

The at least one filling means may be, for example a pusher which pushes the tobacco portion from the shaping chamber into the cigarette tube. A chute on which the tobacco portion is located may be used for this purpose The at least one portioning means defines a block length unit. This block length unit corresponds to the distance the transporting means advances the tobacco block towards the separation means for the making of one cigarette. Thus, one block length unit contains the quantity of tobacco that corresponds to the tobacco portion. A particularly advantageous tobacco block has the shape of a flat, cuboidal body. The short side of that flat, cuboidal body has the dimensions which correspond substantially to the diameter of the tobacco rod which is filled into the cigarette tube. The mid-length side of the flat, cuboidal body has dimensions which correspond substantially to the length of the tobacco rod which is filled into the cigarette tube. The long side of the tobacco block relates to the number of tobacco portions along the tobacco block.

The at least one transport means serves in particular to transport the tobacco block towards the separating means and the shaping chamber. The transport means may be one or more pushers, toothed racks, wedge bars, screws, shafts or wheels that may be pretensioned with a spring, for example friction wheels or toothed wheels, pulling means, for example chains, cable pulls or webs of material. Transportation may be carried out automatically, semi-automatically or manually, for example by moving a lever, a pusher, a button or a wheel. This facilitates the operation of the device, as the operator does not need to advance the tobacco block with his fingers, and thus also increases the precision of the portioning. Furthermore, a transport means advantageously also has at least one guide for the tobacco block. The guide may be an opening of the shaping chamber. Alternatively, lateral guides are attached to the device which guide the tobacco block during transportation. The tobacco block may be guided on two sides, for example on the narrow sides of the tobacco block, on three sides or on four sides. A covering of the tobacco block may also be part of the guide for the tobacco block.

Preferably, the portioning means and the transport means are coupled such that the transport means transports the tobacco block in a number of discrete transport steps. The transport means may be in particular a screw, spindle or threaded shaft respectively with a pusher attached at their forward end.

In an automatic embodiment of the device of the invention, the portioning means may for example be a stepping motor which rotates the screw, spindle or threaded shaft through a predetermined angle each time the motor is energized.

Preferably, the device is hand-operated. In the hand-operated embodiment of the device of the invention, the portioning means is preferably formed by a saw-toothed rack formed along a slide rod and at least one contact element which engages the toothed rack to drive it stepwise forward.

The at least one blocking means preferably is adapted to block the transport means after each transport step until the at least one filling means has been operated, that is the detached tobacco portion has been filled into a cigarette tube and the shaping chamber is empty. This ensures that the shaping chamber is emptied before further tobacco is filled into the shaping chamber to make a further cigarette.

In an automatic embodiment of the device of the present invention, the blocking means may be an electronic command or device controlling the operation of the portioning means, the transport means, the filling means or combinations thereof. For example, a sensor or a switch may detect a given position of the transport means to trigger the blocking means to stop the operation of the transport means until the filling means has been operated.

In a manually operated embodiment, the blocking means is preferably a cam mechanism which prevents the portioning means and the transport means from being actuated successively without intermediate actuation of the filling means. The cam mechanism preferably includes a blocking element which is shiftable between a blocking position and a releasing position. It is shifted from the releasing position into the blocking position by actuation of the portioning means and, when in the blocking position, it blocks a further actuation of the portioning means and the transport means. The blocking element is returned in its releasing position by actuation of the filling means so that the portioning means and the transport means can be actuated only after the filling means has been actuated. This mechanism prevents a further tobacco portion from being transported into the shaping chamber until the previous tobacco portion has been ejected from the shaping chamber and filled into a cigarette tube.

The blocking element is preferably a bi-stable element, for example a toggle bar.

In a preferred embodiment, the device comprises at least one shaping means by means of which the separated tobacco portion may be shaped into a form in which the tobacco portion may be introduced into the cigarette tube by the filling means. The shaping means may be for example one or more plungers, toothed wheels or other mechanisms used to bring the tobacco portion into a substantially cylindrical shape. The density of the tobacco of the tobacco portion may advantageously be slightly higher during shaping than the tobacco is later in the cigarette tube. This facilitates the filling of the shaped tobacco portion into the cigarette tube. The shaping chamber of the device forms a part of the shaping means.

In one embodiment of the device of the invention the movement of the at least one shaping means is coupled with the movement of the separating means. For example, the separating means and the shaping means are attached to a common lever. In another embodiment of the device, only one means is provided which both separates and shapes. In a further embodiment, the movement of the shaping means is superimposed on the movement of the separating means. This means that the separating means is moved for example with a lever in a separating movement, wherein the shaping means is moved along during this movement. Following the separating movement, the shaping means performs a further shaping movement independent of the movement of the separating means in order to shape the detached tobacco. The separating means then moves into the starting position and takes the shaping means with it back into its starting position.

In an preferred embodiment of the device according to the invention, the device comprises a separating means adapted to detach a tobacco portion from a tobacco block, at least one portioning means adapted to portion the tobacco block and at least one transport means adapted to transport the tobacco block towards the separating means, wherein the portioning means and the transport means are coupled such that the transport means transports the tobacco block in a number of transport steps. This embodiment further comprises at least one filling means adapted to fill a cigarette tube with the detached tobacco portion and a fixing means to fix the cigarette tube relative to the device. The fixing means comprises a tubular nozzle and a gripping means. According to this embodiment of the invention, the gripping means is coupled to the movement of the separating means. Preferably, a lever is used to actuate the portioning means. Preferably, the lever that actuates the portioning means also actuates the fixing means, preferable in the same motion. This secures the cigarette tube on the device in a simple manner. Further, due to the coupling of the movements, the utilisation of the device is simplified, as only one hand is required to perform the two functions of gripping and portioning. This allows for a higher speed to fill empty cigarette tubes.

Preferably, the gripping means comprises at least one contoured surface wherein the contoured surface corresponds to at least a section of the nozzle, preferably a semi cylindrical section of the nozzle. This allows a secure gripping of the cigarette tube on the nozzle.

Preferably the gripping means comprises two essentially semi cylindrically contoured surfaces, wherein each semi cylindrically contoured surface is connected to a gripper finger. According to this embodiment of the invention, the gripper fingers are slidably connected to cam walls of a vertical slider, and vertical movement of the vertical slider moves the semi cylindrically contoured surfaces towards the nozzle. Preferably, the gripper fingers are pressurized towards the cam walls of the vertical slider. Although described as a vertical slider, other directions of movement of the slider that engages with the gripping means are envisoned.

BRIEF DESCRIPTION OF THE DRAWINGS

The invention will be further described, by way of example only, with reference to the accompanying drawings in which.

DETAILED DESCRIPTION

Figure 1:
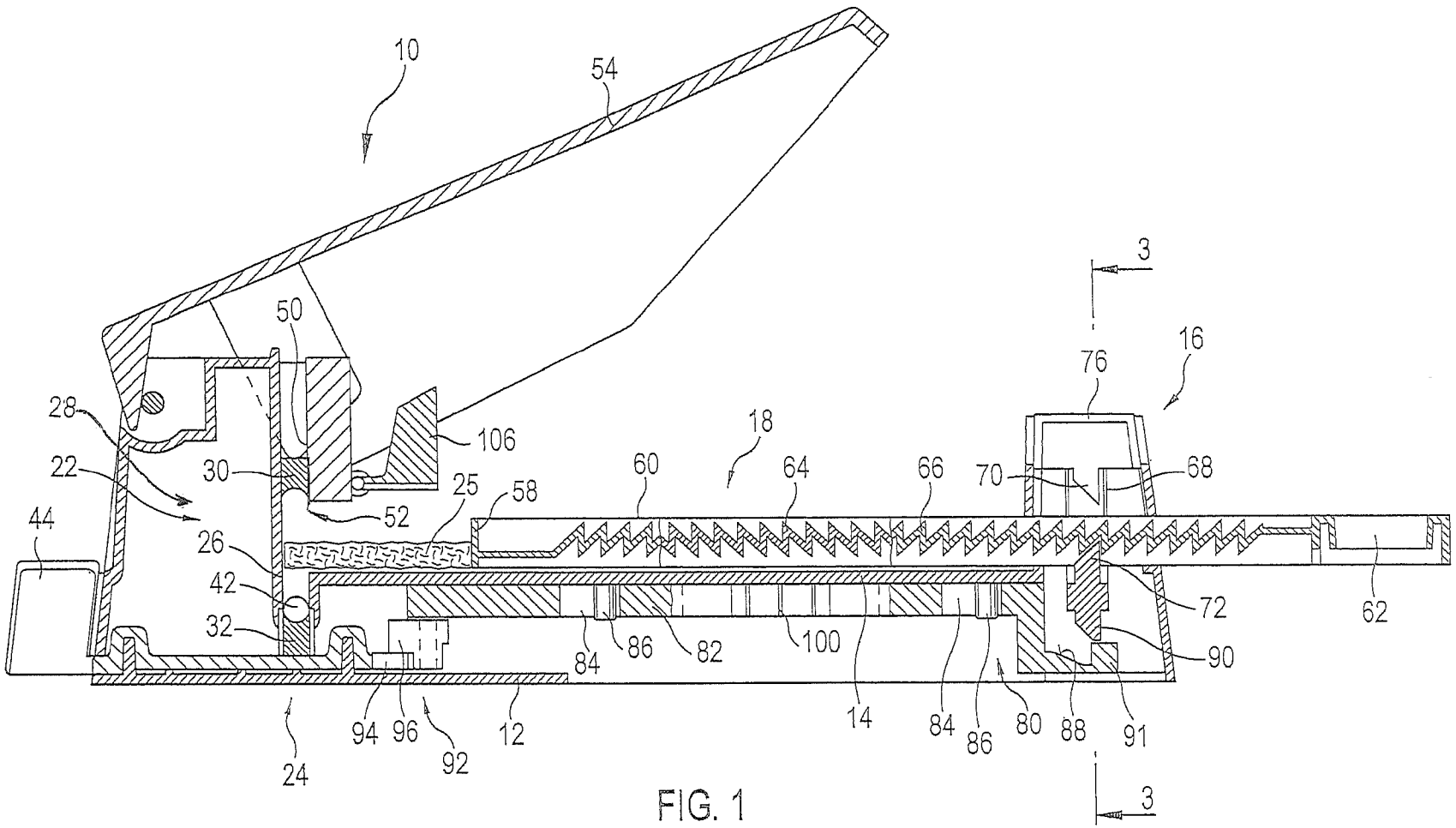
FIG. 1 is a sectional view of a device in accordance to the invention.

The drawings show a manually operated device 10 for filling cigarette tubes 36. The manually operated device 10 comprises a base plate 12 to which the front end of a table 14 is attached, as well as a portioning means 16, a transport means 18, a separating means 50, a shaping block 22 and a filling means 24. The separating means 50, the shaping block 22 and the filling means 24 are mounted on the base plate 12. The table 14 extends from about the centre of the base plate. The portioning means 16 is arranged at the rear end of the table 14. The transport means 18 extends through the portioning means 16 and along the upside of the table 14. To make finished cigarettes with the manually operated device 10 a tobacco block 25 is placed on the table 14 and is transported by the transport means 18 to the separating means 50 and the shaping block 22 arranged in front of the front end of the table 14. The table 14 may have lateral guides for the tobacco block 25.

The shaping block 22 constitutes the shaping means 28 and comprises a shaping chamber 26 and an upper plunger 30 and a lower plunger 32 which can form a tobacco portion into a substantially cylindrical shape. The upper plunger 30 forms the upper end of the shaping chamber 26. It is vertically movable and has at the underside a semicircular recess which extends over the whole length of the upper plunger 30. The lower plunger 32 is arranged at the bottom of the shaping chamber 26 and has at its upside a semicircular recess which extends over the whole length of the lower plunger 32. The length of the plungers 30, 32 corresponds substantially to the length of the tobacco rod 34 inside a cigarette tube 36 of a finished cigarette. The tobacco rod 34 is shaped between the upper and lower plungers 30, 32 by a downward movement of the upper plunger 30. The tobacco portion is compacted to a smaller volume than the capacity of the empty cigarette tube 36.

Figure 2:
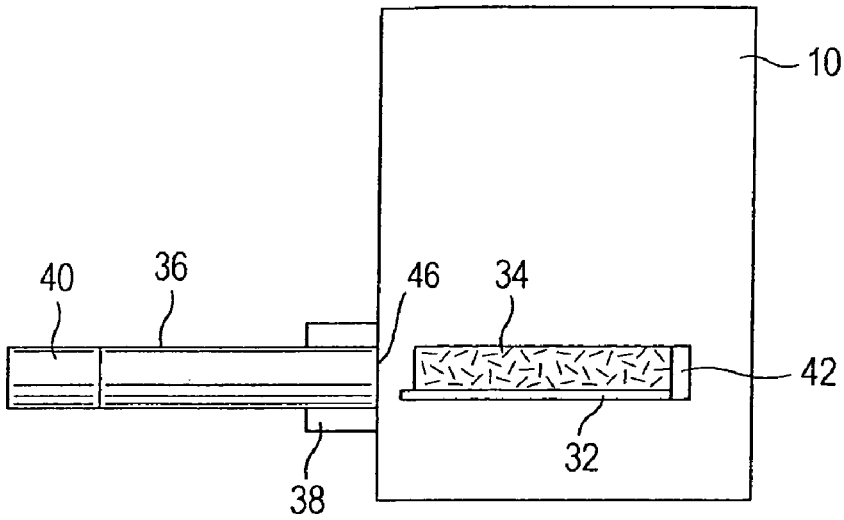
FIG. 2 is a rear side elevational view of FIG. 1.

As shown in FIG. 2, an empty cigarette tube 36 is attached by means of fixing means 38 to an outlet opening 46 of the manually operated device 10, for example fitted to a bush. The cigarette tube 36 may also have a filter 40. The semicircular recess of the lower plunger 32 forms a chute in which the tobacco rod 34 rests. After return of the upper plunger 30 into its upper position, the cigarette rod 34 is pushed from the chute via the outlet opening 46 into the cigarette tube 36 by the filling means 24.

The filling means 24 comprises a pusher 42 and a handle 44 attached to the pusher 42. The lower plunger 32 is horizontally movable and the pusher 44 is attached at its end so that the lower plunger 32 together with the pusher 42 is shifted by the handle 44 for filling the tobacco rod 34 into the cigarette tube 36. Once the cigarette tube 36 is filled with the tobacco portion, the lower plunger 32 and the pusher 42 are returned to their original position inside the shaping chamber 26 by means of the handle 44. The tobacco portion remains substantially completely in the cigarette tube 36.

A separating means 50 is arranged alongside the upper plunger 30. The separating means 50 is a blade 52. The blade 52 may have different cutting geometries, for example straight, curved, round, diagonal, or wedge-shaped. The separating means 50 may be guided in different ways, for example linear, arcuate or scissor-like. The movement of the separating means 50 may be coupled with the movement of the shaping means 28 comprising plungers 30, 32, for example in advance of it. In another embodiment, the movement of the blade 52 is superimposed on the movement of the upper plunger 30. In other words, the blade 52 is moved for example with a lever 54 in a separating movement, wherein the upper plunger 30 is moved along with it during this movement. Following on from the separating movement, the plunger 30 performs a further shaping movement independent of the movement of the blade 52 in order to shape a tobacco rod 34 from the detached tobacco portion. The blade 52 then moves back into the starting position and likewise takes the upper plunger 30 with it into its starting position.

The shaping means 30, 32 and the separating means 50 are moved by the common lever 54 in order to apply greater cutting and shaping forces more easily.

Figure 3:
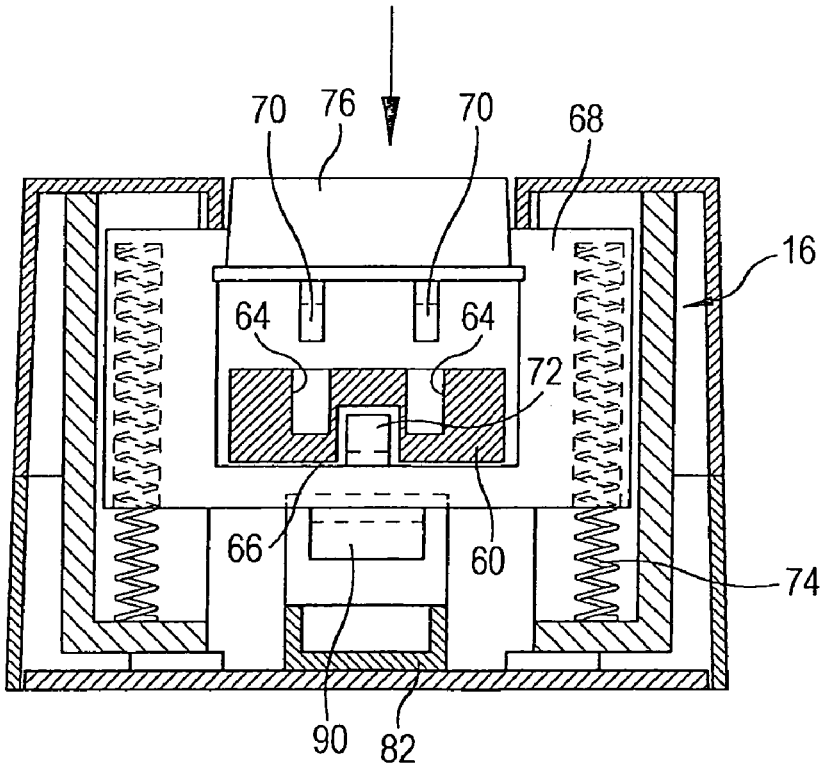
FIG. 3 is a sectional view in the plane 3-3 of FIG. 1 of the portioning means.

The transport means 18 is a pusher 58 which is driven by a slide rod 60. The pusher 58 is attached to the forward end of the slide rod 60 and a handle 62 is attached at the rear end of the slide rod 60. The portioning means 16 comprises a double toothed rack 64, 66 along the slide rod 60. In the toothed rack 64, 66 one chain of teeth is formed on the upside and the other chain of teeth is formed on the underside of the slide rod 60. As shown in FIG. 3, the upside toothed rack 64 is provided in the middle of the slide rod 60 while the underside toothed rack 66 is divided into two series of teeth at either side of upside toothed rack 64. In FIG. 1 a portion is broken away to show also the upside toothed rack 66. The teeth of the toothed racks 64, 66 have saw tooth form, that is the rake of their front faces is about 90 degrees. The rear face has a rake of about 45 degrees. The front faces of the teeth of the upside and underside toothed racks 64, 66 are facing towards the front end of the slide rod 60 at which the pusher 58 is attached.

The portioning means 16 further comprises a vertically reciprocating frame 68 including upper and lower wedge-shaped contact elements 70, 72 which cooperate with the toothed racks 64, 66 at the upside and, respectively, underside of the slide rod 60. The vertically reciprocating frame 68 is housed at the rear end of the table 14 and the slide rod 60 extends through the opening or window surrounded by the frame 68. A spring element 74 biases the vertically reciprocating frame 68 in an upper position. The upper and lower wedge-shaped contact elements 70, 72 extend from the upper frame edge downwards and, respectively, from the lower frame edge upwards. As shown in FIG. 3, the upper contact element 72 is divided into two elements, one for each series of teeth of the upside toothed rack 64. The wedge-shaped contact elements 70, 72 have engagement faces sloping towards the front end of the slide rod 60. An enlarged portion at the upper end of the frame 68 forms a push button 76 so that the user may push down the vertically reciprocating frame 68 into a lower position for actuating the portioning means 16, that is the slide rod 60.

The slide rod 60 is advanced one step forward by pushing down the push button 76 and releasing it again. The length of a step equals the pitch of the upside and underside toothed racks 64, 66. When the frame 68 is pushed downwards by exerting a downward force onto the push button 76, the upper contact element 70 engages the sloping rear face of a tooth of the upside toothed rack 64, whereby the slide rod 60 is advanced forward. The length of the sloping rear face of the upside teeth and the length of the sloping engagement faces of the upper contact element 70 is such that the slide rod 60 is advanced about half a step by the engagement of the upper contact element 70. The toothed racks 64, 66 are horizontally slightly offset relative to each other. When the push button 76 is released, the frame 68 is urged upwards by the biasing spring 74 and the lower contact element 72 engages the sloping rear face of a tooth of the underside toothed rack 66, whereby the slide rod 60 is advanced forward further. The offset of the toothed racks 64, 66, the length of the sloping rear face of the underside teeth and the length of the sloping engagement face of the lower contact element 72 are such that the slide rod 60 will be advanced the remainder of the step.

The frame 68 may be moved into a middle position in which none of the contact elements 70, 72 engages with the toothed racks 64, 66. In this middle position, the slide rod 60 may be pulled out in order to deposit a new tobacco block 25 on the table 14 or to remove an emptied tobacco block 25 from it.

A blocking means 80 is provided which ascertains that the frame 68 cannot be pushed downwards until the tobacco portion previously transported by the transport means 18 into the shaping chamber 26 is pushed out of the shaping chamber 26 by the filling means 24, that is until this tobacco portion is filled in the cigarette tube 36. The blocking means 80 comprises a toggle bar 82 which is arranged underneath the table 14 and in parallel with the slide rod 60. The toggle bar 82 has two oblong apertures 84 into which guiding pins 86 extend from the underside of the table 14. The guiding pins 86 limit the stroke of the toggle bar 82 so that it can only toggle between a blocking forward position and a releasing rearward position.

Figure 4:
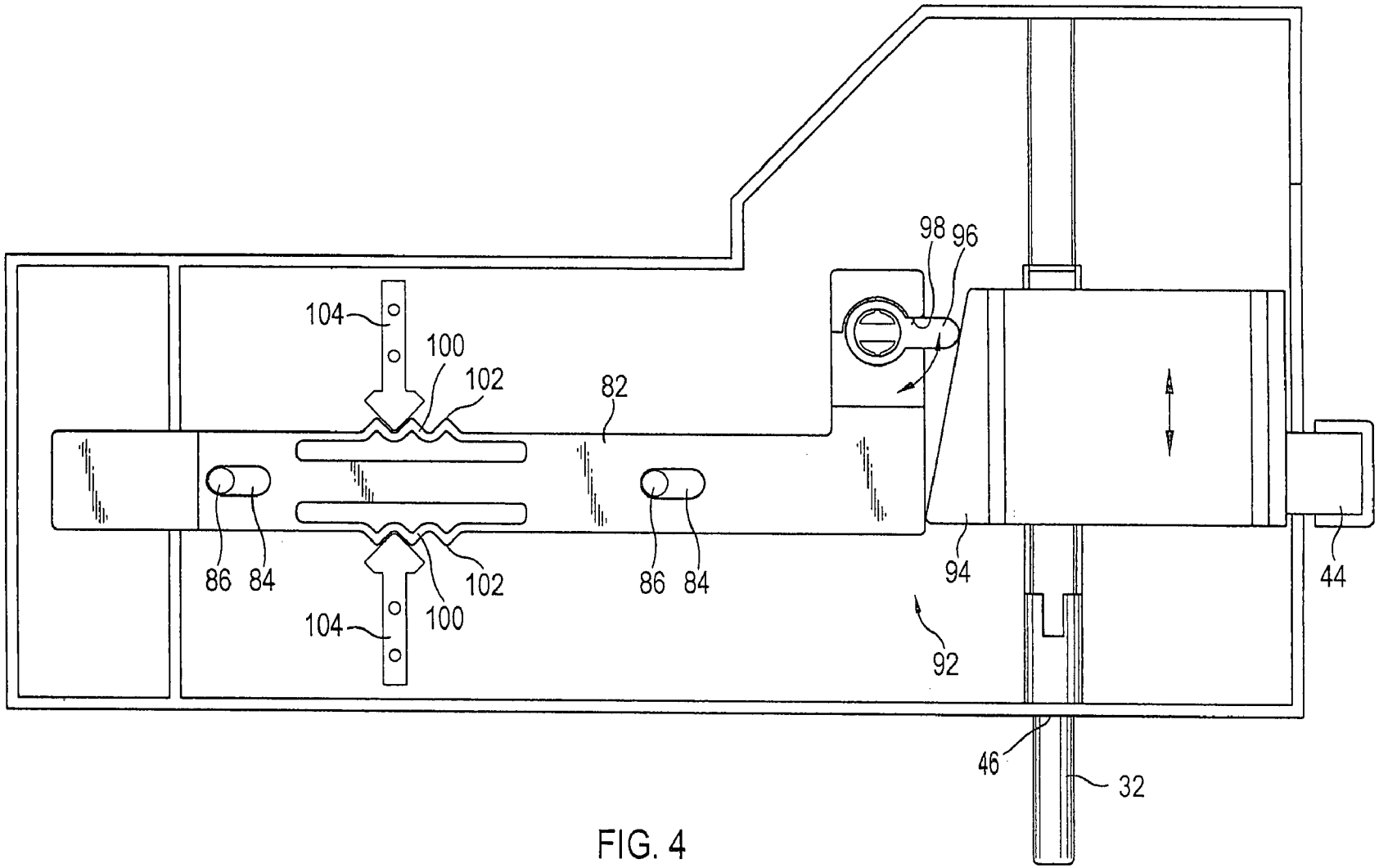
FIG. 4 is a bottom view with the blocking means in the blocking position.

The toggle bar 82 is urged in its forward position by a downward movement of the frame 68 and, when in its forward position shown in FIGS. 1 and 4, blocks the vertically reciprocating frame 68 in its upper position and prevents the frame 68 from being pushed downwards once more by the user. This is achieved by a ramp 88 formed at the portion of the toggle bar 82 extending underneath the frame 68. The ramp 88 rises in forward direction. The frame 68 has a downwards extending contact finger 90 which engages the ramp 88 to urge the toggle bar 82 into its blocking forward position. The toggle bar 82 has a small step 91 rearward of the ramp 88. The small step 91 arrives beneath the contact finger 90 by the ultimate part of the forward movement of the toggle bar 82 which is caused by toggle means described below. A downward movement of the frame 68 is blocked when the small step 91 has arrived beneath the contact finger 90.

Figure 5:
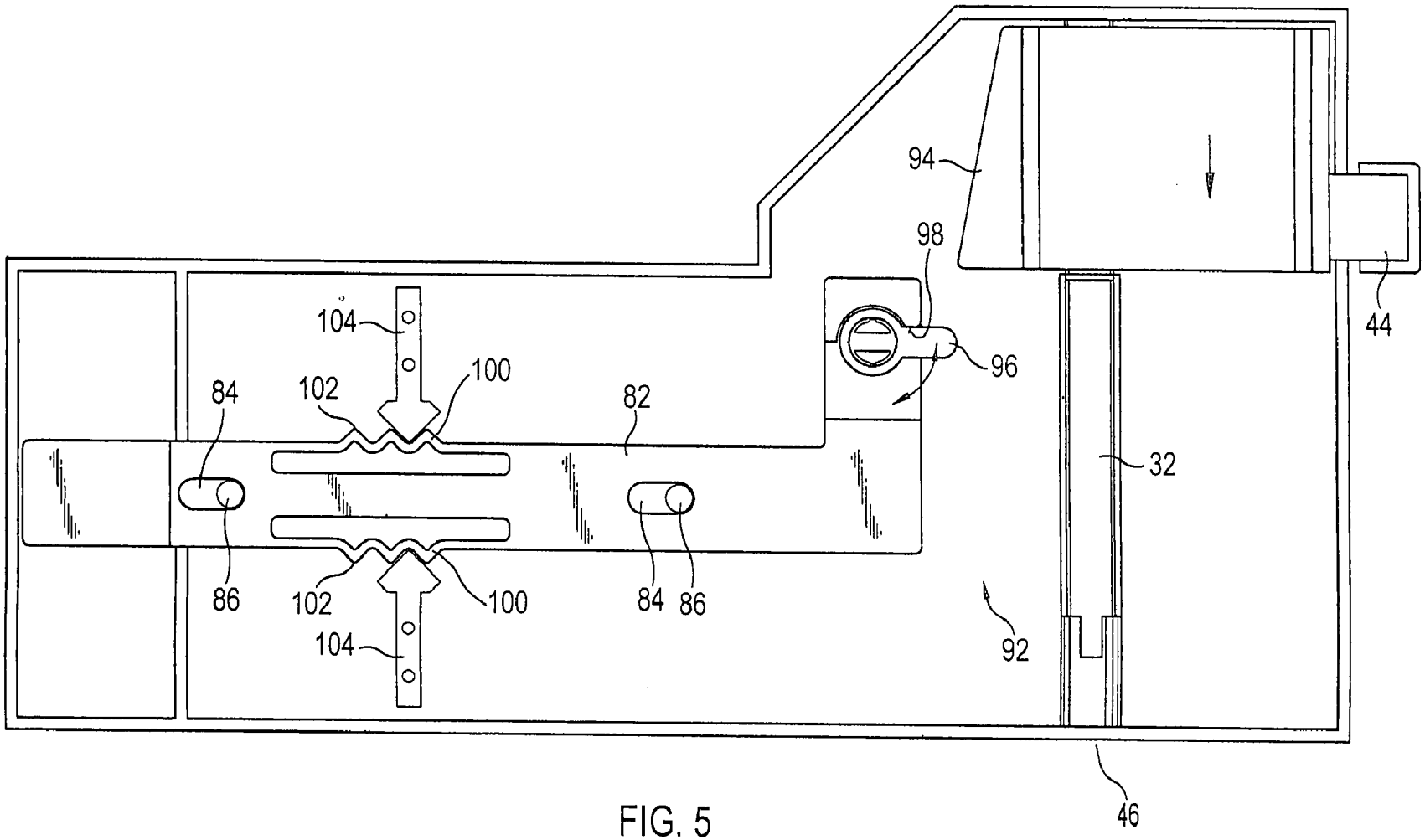
FIG. 5 is a bottom view with the blocking means in the release position.

An actuation of the filling means 24 urges the toggle bar 82 back into its rearward position shown in FIG. 5 so that it releases the vertically reciprocating frame 68. This is achieved by a wedge gear 92 provided between the pusher 42 and the forward end of the toggle bar 82. The wedge gear urges the toggle bar 82 in its rearward releasing position when the pusher 42 of the filling means 24 is retracted after having been actuated to push the tobacco portion out of the shaping chamber 26 into a cigarette tube 36. The wedge gear 92 comprises a shallow ramp 94 at the pusher 42 and a swivelling lever 96 on a lateral extension at the forward end of the toggle bar 82. The shallow ramp 94 lies in a horizontal plane and has the form of a single saw tooth whose front face faces towards the outlet opening 46 of the manually operated device 10 and whose rear face slopes rather gently. The swivelling lever 96 is biased by a spring in a normal position in which it presses against a stop 98 and points in forward direction. The front face of the shallow ramp 94 swivels the swivelling lever 96 aside so that the shallow ramp 94 rides over the swivelling lever 96 without moving the toggle bar 82, when the pusher 42 is being actuated for pushing a tobacco portion out of the shaping chamber 26. The swivelling lever 96 swivels back in its normal forward pointing position when the pusher 42 is pushed completely outwards and the shallow ramp 94 has passed the swivelling lever 96. Afterwards, when the pusher 42 is retracted, the shallow ramp 94, which rises in the pushing direction of the pusher 42, urges against the swivelling lever 96. As the swivelling lever 96 cannot be swivelled in this direction due to the stop 98, the shallow ramp 94 urges the toggle bar 82 in its rearward position in which the frame 68 is released.

The toggle bar 82 is a bi-stable element. In the mid of the length of the toggle bar 82 two flat springs 100 are formed. The flat springs 100 have mid of their length a zigzag portion 102 with three outwards pointing peaks and two intermediate valleys. One toggle finger 104 is mounted on the table 14 on each side of the toggle bar 82 and engages the zigzag portions 102 of the flat springs 100. The toggle bar 82 is urged by the force of the flat springs 100 into one of the two positions where the toggle fingers 104 lie in one of the valleys. The toggle movement between the two valleys correspond to the stroke of the toggle bar 82 defined by the above mentioned guiding pins 86 and oblong apertures 84. The toggle bar 82 is pushed by the contact finger 90 of the vertically reciprocating frame 68 such that the middle peak just passes the toggle finger 104. At this juncture, the contact finger 90 rests against the vertical face of the small step 91. When the push button 76 is released, the frame 68 returns in its upper position and the toggle bar 82 is moved by the force of the flat spring 100 the remainder of the distance and snaps into the other valley. As mentioned above, the small step 91 rearward of the ramp 88 arrives beneath the contact finger 90 at this remainder of movement of the toggle bar 82 and thus blocks a downward movement of the frame 68. To release the toggle bar 82, it is urged by the wedge gear 92 back such far that the middle peak passes again the toggle finger 104 and is then urged in the releasing position by the toggle finger 104 slipping down into the other valley. Thus, the toggle bar 82 toggles between its blocking and releasing positions.

The toothing of the toothed racks 64, 66 can be even or uneven. For example, it may be advantageous to choose a distance between the teeth at the end of the tooth racks 64, 66 that is greater than the distance between the teeth in the middle of the tooth racks 64, 66. This has the effect that the tobacco is compressed stronger at the beginning and at the end of the processing of the tobacco block than it is compressed in the middle of the tobacco block.

Fitted in front of the shaping chamber 26 is a protective flap 106 which prevents fingers from inadvertently being able to be inserted into the shaping chamber 26 when there is no tobacco block resting on the table 14.

The table may further comprise a small opening (not shown in the figures) that opens the view onto a section of the toggle bar 82 from above. In the area underneath the small opening, the toggle bar 82 may carry an indicator, such as a coloured dot, that indicates to the user whether he may operate the transport means 16 or whether he has to operate the filling means 24 first.

Figure 6:
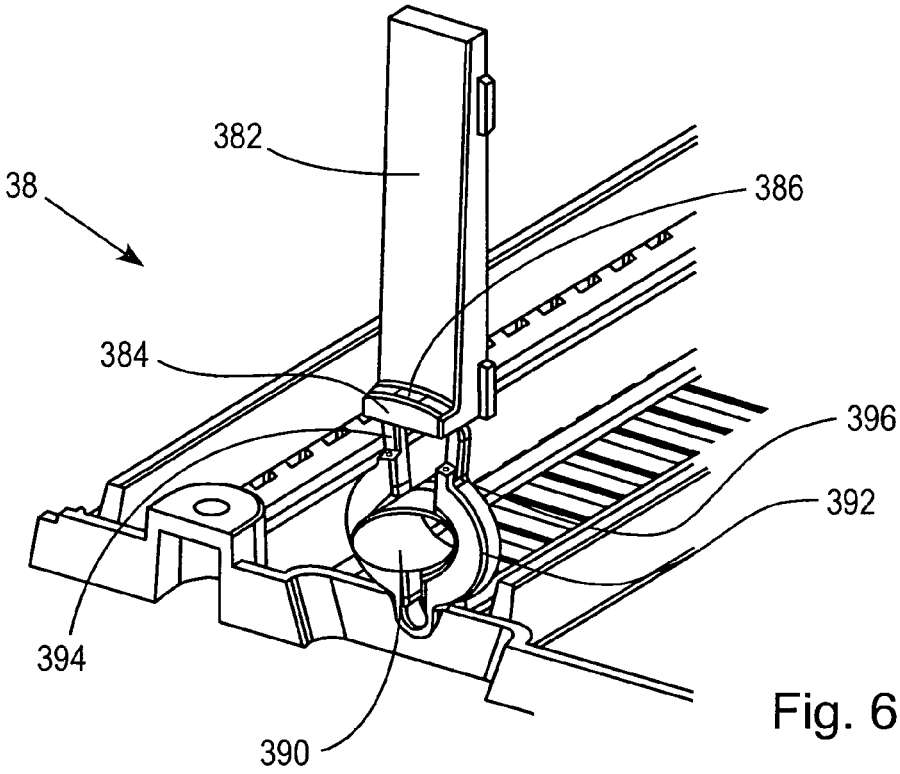
FIG. 6 is an isometric front view of a fixing means with parts of the device according to the invention removed.
Figure 7:
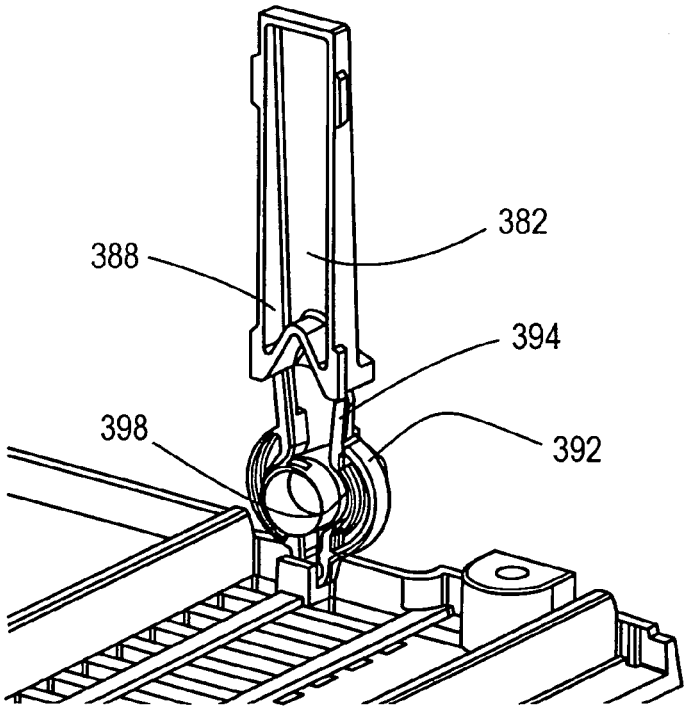
FIG. 7 is an isometric rear view of a fixing means with parts of the device according to the invention removed.

FIGS. 6 and 7 show a particularly advantageous fixing means 38 to attach the cigarette tubes 36 to the device 10. The hollow, cylindrical nozzle 390 is affixed to the housing of the device 10. The opening of the nozzle 390 towards the outside of the device 10 is angled, such that the opening has an elliptical form. This way it is easier to slide the cigarette tubes 36 over the nozzle 390.

A gripper 392 is arranged around the circumference of the nozzle 390. The gripper 392 is made from one piece and comprises a semi cylindrical surface 398, a gripper finger 394 and a gripper rest 396 on each side of the nozzle 390. A semi cylindrical connector joins the two semi cylindrical surfaces 398. The semi cylindrical connector rests in the housing of the device 10.

A vertical slider 382 is movably arranged above the nozzle 390. The vertical slider comprises cam walls 388 on the inside of the vertical slider 382 and a slider nose 384 at the lower end of the vertical slider 382. The slider nose 384 further comprises an engagement surface 386 on the upper end of the slider nose 384. At the lower end of the vertical slider 382, the cam walls 388 are in engagement with the gripper fingers 394. The vertical slider is pretensioned towards the lever 54. In the up position of the lever 54, the vertical slider 382 is also in its up position.

In use, when the lever 54 is moved downwards, at a predetermined position, the lower edge of the lever 54 engages with the engagement surface 386 of the vertical slider 382 and pushes the vertical slider 382 downwards. The gripper fingers 394 are slid along the cam walls 388. The cam walls move the gripper fingers 394 towards each other, thus closing the semi cylindrical surfaces 398 towards the nozzle 390. This fixes the cigarette tube 36 onto the nozzle. The vertical movement of the lever 54 and the vertical slider 382 is stopped by the underside of the slider nose 384 engaging with gripper rest 396. The cigarette tube 36 remains fixed to the nozzle until the tobacco portion has been ejected from the shaping chamber 26 into the cigarette tube 36 and until the lever 54 is moved again into the up position. The semi cylindrical connector of the gripper 392 pressurizes the two semi cylindrical surfaces 398 outward against the cam walls 388 to release the filled cigarette tube 36 once the vertical slider 382 moves up again.

LIST OF REFERENCE NUMBERS

10 manually operated device
12 base plate
14 table
16 portioning means
18 transport means
22 shaping block
24 filling means
25 tobacco block
26 shaping chamber
28 shaping means
30 upper plunger
32 lower plunger
34 tobacco rod
36 cigarette tube
38 fixing means
382 vertical slider
384 slider nose
386 engagement surface
388 cam wall
390 nozzle
392 gripper
394 gripper finger
396 gripper rest
398 contoured surface
40 filter
42 pusher
44 handle
46 outlet opening
50 separating means
52 blade
54 lever
58 pusher
60 slide rod
62 handle
64 upside toothed rack
66 underside toothed rack
68 frame
70 upper contact element
72 lower contact element
74 spring element
76 push button
80 blocking means
82 toggle bar
84 apertures
86 guiding pins
88 ramp
90 contact finger
91 small step
92 wedge gear
94 shallow ramp
96 swivelling lever
98 stop
100 flat spring
102 zigzag portion
104 toggle finger
106 protective flap

The invention claimed is:

1. Device for filling cigarette tubes with tobacco, wherein the device comprises at least one separating means adapted to detach a tobacco portion from a tobacco block;

at least one portioning means adapted to portion the tobacco block;

at least one transport means adapted to transport the tobacco block towards the separating means;

wherein the portioning means and the transport means are coupled such that the transport means transports the tobacco block in a number of transport steps, and wherein the at least one portioning means is coupled to the at least one transport means by a gear mechanism, wherein the gear mechanism comprises at least one toothed rack along the slide rod of the transport means and at least one contact element adapted to engage a tooth of the rack to urge the slide rod forward by one pitch of the toothed rack; and at least one filling means adapted to fill a cigarette tube with the detached tobacco portion, characterized in that the device comprises at least one blocking means adapted to block the transport means after each transport step until the at least one filling means has been operated.

2. Device according to claim 1, wherein the at least one transport means comprises a pusher attached to the forward end of a slide rod.

3. Device according to claim 1, wherein chains of the teeth are formed at the upside and the underside of the slide rod, the teeth having sawtooth form and the front faces of the teeth facing towards the forward end of the slide rod.

4. Device according to claim 3, wherein the at least one blocking means comprises a blocking element reciprocating between a releasing position and a blocking position for releasing and, respectively, blocking the transport means, the blocking element being shifted into the blocking position by the operation of the portioning means and shifted in the releasing position by the operation of the filling means.

5. Device according to claim 4, wherein the blocking element is adapted to toggle between the releasing position and the blocking position.

6. Device for filling cigarette tubes with tobacco, wherein the device comprises at least one separating means adapted to detach a tobacco portion from a tobacco block;

at least one portioning means adapted to portion the tobacco block;

at least one transport means adapted to transport the tobacco block towards the separating means;

wherein the portioning means and the transport means are coupled such that the transport means transports the tobacco block in a number of transport steps, and wherein the at least one portioning means is coupled to the at least one transport means by a gear mechanism, wherein the gear mechanism comprises at least one toothed rack along the slide rod of the transport means and at least one contact element adapted to engage a tooth of the rack to urge the slide rod forward by one pitch of the toothed rack;

at least one filling means adapted to fill a cigarette tube with the detached tobacco portion, and a fixing means to fix the cigarette tube relative to the device, wherein the fixing means comprises a tubular nozzle, characterized in that the fixing means further comprises a gripping means, wherein the gripping means is coupled to the movement of the separating means.

7. Device according to claim 6, wherein the gripping means comprises at least one contoured surface wherein the contoured surface corresponds to at least a section of the nozzle, preferably a semi cylindrical section of the nozzle.

8. Device according to claim 6, wherein the gripping means comprises two essentially semi cylindrically contoured surfaces, wherein each semi cylindrically contoured surface is connected to a gripper finger, wherein the gripper fingers are slidably connected to cam walls of a vertical slider, wherein vertical movement of the vertical slider moves the semi cylindrically contoured surfaces towards the nozzle.

9. Device for filling cigarette tubes with tobacco, wherein the device comprises at least one separating arrangement adapted to detach a tobacco portion from a tobacco block;

at least one portioning arrangement adapted to portion the tobacco block;

at least one transport arrangement adapted to transport the tobacco block towards the separating arrangement;

wherein the portioning arrangement and the transport arrangement are coupled such that the transport arrangement transports the tobacco block in a number of transport steps, and wherein the at least one portioning arrangement is coupled to the at least one transport arrangement by a gear mechanism, wherein the gear mechanism comprises at least one toothed rack along the slide rod of the transport arrangement and at least one contact element adapted to engage a tooth of the rack to urge the slide rod forward by one pitch of the toothed rack;

at least one filling arrangement adapted to fill a cigarette tube with the detached tobacco portion, and at least one blocking arrangement adapted to block the transport arrangement after each transport step until the at least one filling arrangement has been operated.

10. Device according to claim 9, wherein the at least one transport arrangement comprises a pusher attached to the forward end of a slide rod.

11. Device according to claim 9, wherein chains of the teeth are formed at the upside and the underside of the slide rod, the teeth having sawtooth form and the front faces of the teeth facing towards the forward end of the slide rod.

12. Device according to claim 11, wherein the at least one blocking arrangement comprises a blocking element reciprocating between a releasing position and a blocking position for releasing and, respectively, blocking the transport arrangement, the blocking element being shifted into the blocking position by the operation of the portioning arrangement and shifted in the releasing position by the operation of the filling arrangement.

13. Device according to claim 12, wherein the blocking element is adapted to toggle between the releasing position and the blocking position.

* * * * *